US007335452B2

(12) United States Patent
Perry et al.

(10) Patent No.: US 7,335,452 B2
(45) Date of Patent: Feb. 26, 2008

(54) SUBSTRATE WITH PLYWOOD SUPPRESSION

(75) Inventors: Philip G. Perry, Webster, NY (US); Gary J. Maier, Webster, NY (US); Gene W. O'Dell, Williamson, NY (US); William G. Herbert, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 412 days.

(21) Appl. No.: 10/991,695

(22) Filed: Nov. 18, 2004

(65) Prior Publication Data

US 2006/0105256 A1 May 18, 2006

(51) Int. Cl.
*G03G 15/04* (2006.01)

(52) U.S. Cl. ..... 430/69; 430/127; 430/133; 430/134; 216/52

(58) Field of Classification Search ..... 430/69, 430/127, 133, 134
See application file for complete search history.

(56) References Cited

U.S. PATENT DOCUMENTS

| | | | |
|---|---|---|---|
| 5,003,851 | A | 4/1991 | Kawada et al. |
| 5,069,758 | A | 12/1991 | Herbert et al. |
| 5,096,792 | A | 3/1992 | Simpson et al. |
| 5,170,683 | A | 12/1992 | Kawada et al. |
| 5,228,369 | A | 7/1993 | Itoh et al. |
| 5,302,485 | A | 4/1994 | Swain |
| 5,309,200 | A | 5/1994 | Michlin |
| 5,346,556 | A | 9/1994 | Perry et al. |
| 5,381,213 | A | 1/1995 | Michlin |
| 5,506,786 | A | 4/1996 | Itoh et al. |
| 5,510,217 | A | 4/1996 | Hongo et al. |
| 5,534,172 | A | 7/1996 | Perry et al. |
| 5,566,598 | A | 10/1996 | Kawada et al. |
| 5,821,026 | A | 10/1998 | Byers et al. |
| 5,919,594 | A | 7/1999 | Perry et al. |
| 5,955,231 | A | 9/1999 | Yasuda et al. |
| 6,051,148 | A | 4/2000 | Perry et al. |
| 6,108,513 | A | 8/2000 | Landa et al. |
| 6,331,371 | B1 | 12/2001 | Matsui |
| 6,379,858 | B1 | 4/2002 | Perry et al. |
| 6,416,389 | B1 | 7/2002 | Perry et al. |
| 6,534,227 | B2 | 3/2003 | Kabata et al. |
| 6,574,023 | B2 | 6/2003 | Matsui et al. |
| 6,762,779 | B2 | 7/2004 | Miho et al. |
| 2003/0124762 | A1 | 7/2003 | Hashimoto |

*Primary Examiner*—Mark A. Chapman
(74) *Attorney, Agent, or Firm*—Pepper Hamilton LLP

(57) ABSTRACT

The present disclosure provides photoreceptors and methods for fabricating photoreceptors. Photoreceptor device surfaces and fabrication methods have been designed to suppress a "plywood effect." One method includes providing a substrate, rotating the substrate, lathing the substrate with a cutting tool and a cutting fluid by at least one pass, cleaning the substrate to remove the cutting fluid, and depositing onto the substrate at least one layer.

22 Claims, 2 Drawing Sheets

SUBSTRATE WITH PLYWOOD SUPPRESSION

BACKGROUND

1. Technical Field

The present disclosure generally relates to photoreceptors and methods for fabricating photoreceptors. More particularly, the disclosure generally relates to photoreceptor device surfaces and fabrication methods that suppress a "plywood effect".

2. Description of Related Art

Substrates used for photoreceptors are typically made from cylindrical aluminum tubes. To achieve the desired dimensional properties required for these devices the aluminum tubes are often machined on a lathe and left with a specular or mirror surface which produces congruent reflection upon exposure to radiation. When employing coherent exposure radiation for printer products an undesirable print artifact termed "plywood" is produced in the high density areas as described in further detail hereinbelow.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is the creation of two dominant reflections of the incident coherent light on the surface of the photoreceptor, for example, a first reflection from the top surface and a second reflection from the bottom surface of the relatively opaque conductive ground plane. This condition is shown in FIG. 1; coherent beams 1 and 2 are incident on a layered photoreceptor 6 comprising a charge transport layer 7, charge generator layer 8, and a ground plane 9. The two dominant reflections are: from the top surface of layer 7, and from the top surface of ground plane 9. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and hence, less light is absorbed by charge generator layer 8. The difference in absorption in the charge generator layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. FIG. 2 shows the areas of spatial exposure variation (at 25×) within a photoreceptor of the type shown in FIG. 1 when illuminated by a He—Ne laser with an output wavelength of 633 nm. The pattern of light and dark interference fringes look like the grains on a sheet of plywood. Hence the term "plywood effect" is generically applied to this problem.

One method of compensating for the plywood effect known to the prior art is to increase the thickness of and, hence, the absorption of the light by the charge generator layer. For most systems, this leads to unacceptable tradeoffs; for example, for a layered organic photoreceptor, an increase in dark decay characteristics and electrical cyclic instability may occur. Another method, disclosed in U.S. Pat. No. 4,618,552 is to use a photoconductive imaging member in which the ground plane, is formed with a rough surface morphology to diffusively reflect the light.

U.S. Pat. No. 4,618,552 discloses a photoconductive imaging member in which the ground plane, or an opaque conductive layer formed above the ground plane, is formed with a rough surface morphology to diffusely reflect the light.

As discussed in the references, a method for compensating for the plywood effect is to provide for a photosensitive imaging member having a roughened surface to difftisively reflect the light. One known method for providing a roughened surface is the liquid honing technique which involves spraying the surface to be roughened with a mixture comprised of water and abrasive particles. Liquid honing, however, is disadvantageous in several respects. One disadvantage arises from the diamond turning or precision extrusion drawing of the substrate prior to liquid honing. In the diamond turning process, a diamond is utilized as a cutting tool while the substrate is rotated at high surface speed (about 20,000 inch per minute) to produce a very smooth, highly reflective surface. Typical surface finishes of about $R_a \approx 0.05$ micron and about $R_t \approx 0.5$ micron are produced. $R_a$ represents the mean roughness of the surface, and $R_1$ represents the vertical distance between the highest peak and the lowest valley of the roughness profile of the surface.

Typically, after diamond turning or extrusion drawing and before liquid honing, the substrate is removed from the lathe or drawing table, lubricant and/or debris resulting from the diamond turning and drawing are removed, and the substrate is cleaned and remounted on a honing machine. This procedure is inefficient since the liquid honing step cannot occur until after the substrate is remounted on the honing machine. Another disadvantage is that a liquid honed surface, such as that involving blasting aluminum substrates with abrasive particles, may exhibit a relatively irregular surface texture having angular, sharp shaped features with holes, fissures, and shaped abrasive particles which are used to hone the surface which can then impact the print quality as well as the sensitivity of the motor receptor. Honing adds to the manufacturing cost, and the resulting media can be defective, especially if it is not thoroughly cleaned after honing.

Accordingly there is a need for fabricating a photoreceptor device having an irregular surface that enables a light scattering ability to eliminate the "plywood effect".

SUMMARY

The disclosure is directed to methods of manufacturing a photoreceptor device having a textured surface. A method may comprise: providing a substrate, rotating the substrate, lathing the substrate with a cutting tool and a cutting fluid by at least one pass, cleaning the substrate to remove the cutting fluid, and depositing onto the substrate at least one layer. The substrate may comprise aluminum or an aluminum alloy. The substrate may not yield substantial coherent reflection. The cutting fluid may comprise at least one antioxidant, one or more surfactants, at least one of which is a polysiloxane surfactant, at least one lubricant, and water. The cutting fluid may be maintained at a substantially neutral pH.

The lathing step may include producing an irregular surface to allow for light scattering. The lathing step may be repeated at least two times, wherein one or more of a composition of the cutting tool, a traverse lathe speed, and a feed rate are varied between the repeated steps. The lathing and cleaning steps may yield a textured substrate exhibiting a surface roughness from about from about 0.050 microns to about 0.210 microns and a maximum roughness depth of up to about 5 microns. Manufacturing may be performed without separately honing the substrate. A feed rate of the cutting tool may be about 0.002 to about 0.010 inches per revolution of the substrate. One or more layers deposited onto the substrate may comprise a charge generation layer having a substantially uniform thickness, a charge transport material, a charge generation layer and a charge transport material, or a charge blocking layer.

Another embodiment is a method of manufacturing a photoreceptor device having a textured surface, the method comprising: lathing a substrate with a cutting fluid by at least one pass, cleaning the substrate to remove the cutting fluid, wherein the cutting fluid comprises at least one antioxidant, one or more surfactants including a polysiloxane surfactant, at least one lubricant, and water, repeating the lathing and cleaning at least one time each, wherein one or more of a cutting tool, a traverse lathe speed and a feed rate are varied between the lathing steps, and depositing onto the substrate at least one layer.

Another embodiment is a photosensitive substrate comprising: a textured surface, wherein the textured surface exhibits a surface roughness from about 0.050 microns to about 0.210 microns and a maximum roughness depth of up to about 5 microns, a charge generating layer on the textured surface, and a charge transport layer on the textured surface. The roughness of the textured surface may be produced by: lathing the substrate with a cutting fluid by at least one pass without separately honing the substrate, and cleaning the substrate to remove the cutting fluid. The substrate may comprise aluminum. The charge generating layer may comprise at least pigment and a resin binder. The charge transport layer may comprise a positive hole transporting material.

DETAILED DESCRIPTION

Figure 1:
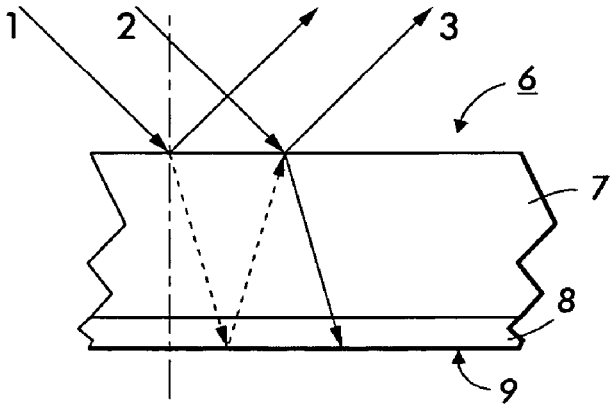
FIG. 1 (PRIOR ART)
FIG. 1 illustrates a coherent light incident upon a prior art layered photosensitive medium leading to reflections internal to the medium.
Figure 2:
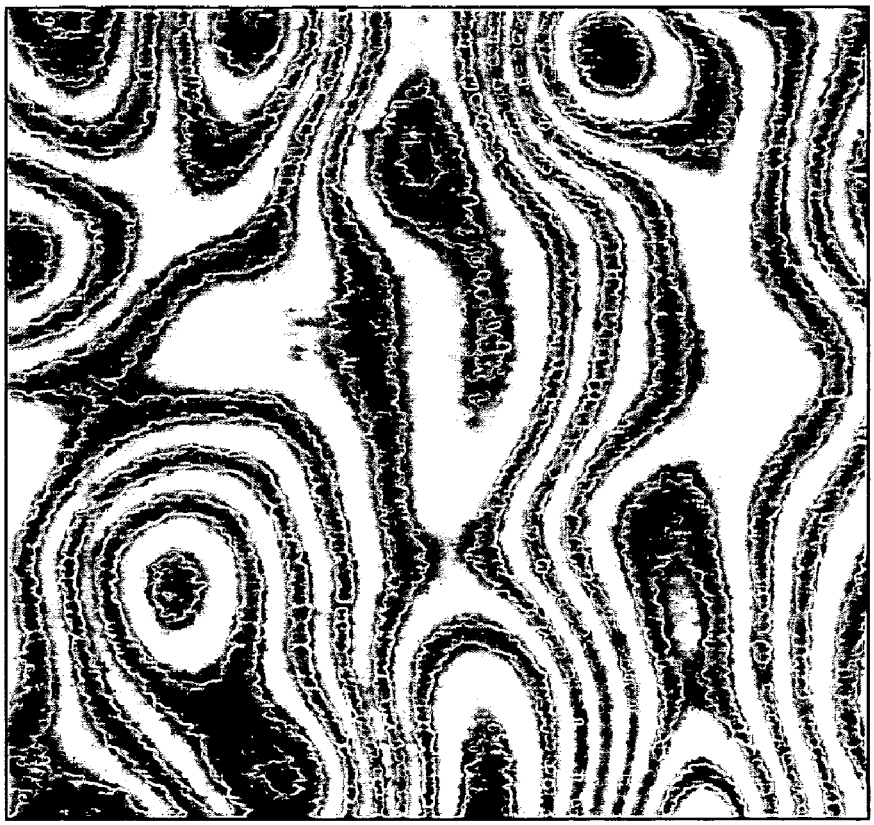
FIG. 2 illustrates a spatial exposure variation plywood pattern in the exposed photosensitive medium of FIG. 1 produced when the spatial variation in the absorption within the photosensitive member occurs due to an interference effect.

This disclosure describes a substrate machining process which provides a light scattering effect upon exposure, hence reducing and/or eliminating the need for additional material or process steps in manufacturing a photoreceptor devices.

A substrate may have a suitable shape including, for example, a plate, seamless belt, hollow or solid cylinder, and the like. Preferably the substrate may be a hollow cylinder having an imaginary axis, the exposed outer metal surface, a first end and as second end. The member may include any suitable metallic material. Typical materials include, for example, metals such as aluminum, aluminum alloys, stainless steel, brass, nickel and the like. Generally the substrates are relatively soft and preferably characterized with a yield strength of between about 10,000 pounds/in$^2$ and about 20,000 pounds/in$^2$. Homogeneous aluminum or aluminum alloys are preferred. Typical aluminum alloys include, for example, 1050, 1100, 3003, 6061, 6063 and the like.

Surface roughness can be characterized by the following parameters: $R_a$ (mean roughness) and $R_{max}$ (maximum roughness depth). $R_a$ is the arithmetic average of all departures of the roughness profile from the center line with the evaluation length. The expression $R_{max}$ represents the largest single roughness gap within the evaluation length. The evaluation length is that part of the traversing length that is evaluated. Measurements of the various surface roughness parameters described herein may be made with a tracing instrument such as a profilometer, including but not limited to a Perthen Model S3P or Model S8P manufactured by Mahr Feinpreuf Corporation. Generally, a stylus with a diamond tip is traversed over the surface of the roughened substrate at a constant speed, such as 0.5 mm/sec, to obtain all data points within an evaluation length, such as a length of 0.8 mm.

Aluminum, including aluminum-containing and aluminum alloy-containing, substrate members are often used because they comprise a relatively soft material. Other substrates such as stainless steel, nickel, brass and alloys also may be used for alternate embodiments. In one embodiment, net drawn aluminum hollow metal cylinders or drums may be used. The use of aluminum tubes net drawn to desired dimensional specifications eliminates the need for subsequent lathe machining to achieve required dimensions.

The lathing process described herein provides a specular surface while reducing and/or eliminating the source of interference reflection. In an embodiment, a two tool lathing process may consist of a rough tool pass and a finishing pass. The rough tool pass may be made using an abrasive tool such as a carbide steel tool. The finishing pass may preferably use harder tool, such as a superabrasive-tipped tool having a diamond cutting edge. As an example, a rough cut pass for a 30 mm diameter aluminum substrate may have the following operating parameters: speed of rotation from about 4,500 to about 10,000 rotations per minute (RPM), preferably about 7,200 to about 8,000 RPM. The feed rate, or the amount by which the tool is advanced during the substrate during lathing to yield a desired penetration depth, may range, for example, from about 0.002 to about 0.010 inches per revolution, preferably about 0.008 inches per revolution. The rough cut depth of the cut may have little influence on the final surface parameters, but it may be used to help obtain a desired outside diameter tolerance and to determine the final shape of the aluminum substrate. The finishing cut, which may be a diamond cut or other appropriate cut, may has the following exemplary lathe operating parameters: (i) speed of about 4,500 to about 10,000 rotations per minute (RPM), preferably about 7,200 to about 8,000 RPM; (ii) feed rate of about 0.002 to about 0.010 inches per revolution, preferably about 0.004 inches per revolution; (iii) depth of cut from about 0.0003 to about 0.005 inches, preferably about 0.001 inches. These are examples of a typical 30 mm diameter aluminum substrate. With a different diameter and or a different material, an entire different set of conditions would be required.

A substrate may be lathed using one or more cutting tools and any suitable cutting fluid composition known to one skilled in the art, including but not limited to aqueous-based cutting fluids containing: (i) at least one antioxidant; (ii) one or more surfactants, at least one of which is a polysiloxane surfactant; (iii) at least one lubricant; and (iv) water, such as those more fully described in U.S. Pat. No. 5,534,172, to Perry et al., which is incorporated herein by reference in its entirety. For example, the cutting fluid may contain: (i) from about 0.1 to about 10 parts by weight of antioxidant; (ii) from about 0.1 to about 5 parts by weight of surfactant; (iii) from about 1 to about 20 parts by weight of lubricant; and (iv) from about 65 to about 98.8 parts by weight of water, the sum of (i)-(iv) being 100 parts by weight. In another example, the cutting fluid may contain: (i) from about 0.5 to about 2 parts by weight of antioxidant; (ii) from about 0.5 to about 3 parts by weight of surfactant; (iii) from about 2 to about 10 parts by weight of lubricant; and (iv) from about 85 to about 97 parts by weight of water, the sum of (i)-(iv) being 100 parts by weight. In a more specific example, the cutting fluid may contain (i) about 1 part by weight of antioxidant; (ii) about 2 parts by weight of surfactant; (iii) about 10 parts by weight of lubricant; and (iv) about 87 parts by weight of water. In yet another embodiment, the cutting fluid may contain: (i) about 0.01 to about 5 parts by weight of at least one antioxidant; (ii) about 0.1 to about 5 parts by weight of one or more surfactants, wherein at least one of the surfactants is a water soluble polysiloxane in an amount of about 0.01 to about 3 parts by weight; (iii) about 1 to about 20 parts by weight of at least one lubricant; and (iv) about 70 to about 98.9 parts by weight deionized water, whereby the pH of the cutting fluid is from about 7.0 to about 8.0. In yet another embodiment, the cutting fluid may comprise: (i) about 0.01 to about 1 part by weight of at least one antioxidant; (ii) about 1 to about 4 parts by weight of one or more suffactants, including about 0.01 to about 1 part by weight of at least one water-soluble polysiloxane surfactant; (iii) about 1 to about 4 parts by weight of at least one lubricant; and (iv) about 90 to about 98 parts by weight of deionized water.

The antioxidant may inhibit or prevent corrosion and/or spontaneous combustion of any metallic fines. In one embodiment, the antioxidant may be an amine or carboxylic acid salt. Typical amines that may be used in the cutting fluid include, for example, triethanolamine, ethylene diamine tetraacetic acid (EDTA), an amine borate, or an amine carboxylate.

The surfactant may provide substantially uniform cutting fluid coverage on the substrate after machining, and it also facilitates removal of the cutting fluid's residues. In one embodiment, the surfactant may be of a non-foaming type that will facilitate removal of the lubricant yet not substantially react with metal on the substrate surface to produce etching or to increase its surface energy so that subsequent rinsing in deionized water or another liquid causes the surface to remain wet. The surfactant can be anionic, cationic or nonionic. In one embodiment, the surfactant is non-ionic and has a hydrophilic/lipophilic balance (HLB) of greater than about 12, and preferably in the range of from about 12 to about 18. Other HLBs are possible. Examples of suitable anionic surfactants include, for example, higher alkyl sulfonates, higher alcohol sulfuric acid esters, phosphoric acid esters, carboxylates, and the like. Examples of suitable cationic surfactants include, for example, benzalkonium chloride, Sapamine-type quartenary ammonium salts, pyridinium salts, amine salts, and the like. Preferably, the surfactant is non-ionic. Examples of suitable non-ionic surfactants include copolymers of propylene oxide and ethylene oxide, and ethoxylated ethanols, and the like. In one embodiment, the surfactant may be Triton X-114 (octylphenoxy polyethoxy ethanol), Pluronic L-35 (propyleneoxide/ethyleneoxide copolymer) or Alkamuls PSML20 (polyoxyethylene sorbitan monolaurate).

The lubricant may provide a smooth cutting action, reduce or minimize chipping and help to ensure minimal wear to the cutting tool. In one embodiment, the lubricant may be a polyhydric alcohol such as a dihydric alcohol, e.g., glycol such as ethylene glycol, propylene glycol, trimethylene glycol, and neopentyl glycol; a dihydric alcohol containing ether bonds such as diethylene glycol and dipropylene glycol; a dihydric alcohol derived through nitrogen such as diethanolamine; or a dihydric alcohol containing ester bonds such as oleic acid monoglyceride. Examples of other polyhydric alcohols include glycerin, pentaerythritol, sorbitan monolaurate, and sorbitan trioleate. In one embodiment, the lubricant used is polyethylene glycol.

Water may function as a coolant/diluent to control the temperature of the substrate and cutting tool and as a solvent/carrier for the other components of the cutting fluid composition. The water is preferably distilled or deionized water. Preferably, deionized water having a resistivity greater than about 2 Mohm-cm is used, although other types of water with different resistivity may be used.

Optionally, an acid may be added to the cutting fluid composition to provide the composition with a neutral pH of from about 6 to about 8. A substantially neutral pH helps to minimize reactions with the aluminum substrate surface. More preferably, the pH may be between about 7.0 and about 7.5.

In an embodiment, a two tool lathing process may consist of a rough tool pass and a finishing pass. The finishing pass may preferably use a diamond cutting edge. As an example, a rough cut pass for a 30 mm diameter aluminum substrate may have the following operating parameters: speed of rotation from about 4,500 to about 10,000 rotations per minute (RPM), preferably about 7,200 to about 8,000 RPM. The feed rate may range, for example, from about 0.002 to about 0.010 inches per revolution, preferably about 0.008 inches per revolution. The rough cut depth of the cut may have little influence on the final surface parameters, but it may be used to help obtain a desired outside diameter tolerance and to determine the final shape of the aluminum substrate. The finishing cut, which may be a diamond cut or other appropriate cut, may have the following exemplary lathe operating parameters: (i) speed of about 4,500 to about 10,000 rotations per minute (RPM), preferably about 7,200 to about 8,000 RPM; (ii) feed rate of about 0.002 to about 0.010 inches per revolution, preferably about 0.004 inches per revolution; (iii) depth of cut from about 0.0003 to about 0.005 inches, preferably about 0.001 inches. These are examples of a typical 30 mm diameter aluminum substrate. With a different diameter and or a different material, an entirely different set of conditions would be required.

Figure 3:
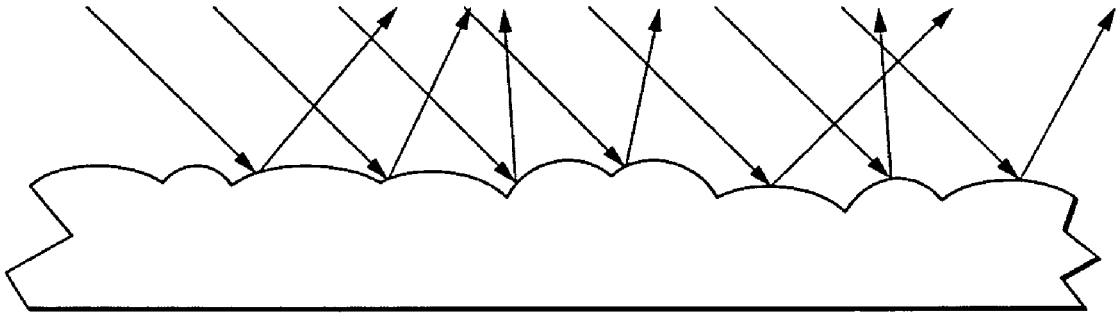
FIG. 3 illustrates an exemplary substrate surface produced by a single pass lathe operation.

An example of a surface pattern that may result from the diffuse lathing process is illustrated in FIG. 3, which illustrates the exemplary specular surface pattern that may result from a lathing process. Also illustrated in FIG. 3 is an exemplary light scattering pattern that may result from a lathing process.

The substrate may then be rinsed with a cleaning fluid, such as deionized water, or optionally water mixed with a mild detergent, or only a mild detergent, such as that disclosed in U.S. Pat. No. 5,723,422 to O'Dell, et al., which is incorporated herein by reference in its entirety. In an embodiment, pressurized spray rinsing may be used for the first rinse so that the impingement force of the spray will aid in removing the residual cutting fluid. The deionized water or other fluid may be sprayed onto the substrate at a sufficient pressure and for a sufficient time to remove substantially all of the cutting fluid residuals from the substrate. For example, in an embodiment the substrate may be spray rinsed using pressures from about 25 to about 75 psi, and optionally about 50 psi, for a period of from about 0.5 to about 1.5 minutes, optionally about 1 minute. The rinsing may be performed while rotating the substrate, such as at a speed of from about 50 to about 150 rpm. Other pressures, time frames and rotation speeds are possible.

After lathing and cleaning, the resulting substrate may have a surface roughness that scatters light sufficiently to substantially reduce or eliminate coherent reflection of light, thus eliminating the plywood effect. Thus, the substrate may have a plywood suppressing specular or reflective surface. The surface roughness can be measured with an instrument called a profilometer. When using a profilometer manufactured by Mahr Feinpruef Corporation (model S8P or S3P) and the following measurement conditions: tracing speed of 0.50 mm/sec, cut off length of 0.8 mm and a stylus of 0.25 microns, in some embodiments the surface roughness may be characterized by $R_a$ ranging from about 0.050 to about 0.210 optionally about 0.090±0.015 microns. The surface roughness may also be characterized by a $R_{max}$ ranging up to about 5 microns, and preferably up to about 1 micron.

After cutting fluid residues are removed from the substrate, the substrate may be coated with any suitable coating or coatings to fabricate a photosensitive imaging member. In fabricating a photosensitive imaging member, after lathing and cleaning a substrate as described above, a barrier uncoat material (UCM) may be applied, followed by a charge generating material (CGM) and a charge transport material (CTM) which may be deposited onto the substrate surface, either in: (i) a laminate type configuration where the CGM and CTM are in different layers; or (ii) a single layer configuration where the CGM and CTM are in the same layer along with a binder resin. When applied as different layers, the CTM in a charge transport layer may be applied to the substrate surface prior to or subsequent to application of the CGM in a charge generating layer Typical organic photoconductive CGMs include, for example, one or more of azo pigments, such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, titanyl phthalocyanine, hydroxy gallium phthalocyanine and the like; quinacridone pigments; or azulene compounds. Typical inorganic photoconductive CGMs include, for example, cadmium sulfide, cadmium sulfoselenide, cadmium selenide, crystalline and selenium, lead oxide and other chalcogenides. Preferably, the CGM includes at least one photosensitive pigment. $R_t$, a measure of peak roughness at 0.1 mm, may be as low as about 40 counts, preferably, $R_t$ (at 0.1 mm) is at least about 300 counts. $R_t$ measuring peak roughness at 0.4 mm is preferably about 0, although $R_t$ (at 0.4 mm) counts of up to about 150 and other $R_t$ counts are possible.

The CGM may also include a layer of electrically conductive or non-conductive binder material such as an organic or inorganic composition. Any suitable resin binder material may be employed in the CGM. Exemplary resins include polycarbonates, acrylate polymers, methacrylate polymers, vinyl polymers, cellulose polymers, polyesters, polysiloxanes, polyamides, polyurethanes, epoxies, polyvinylacetals, and the like. Preferably, a vinyl resin is used in CGM.

Any suitable CTM may be used. Typical CTMs include, for example, one or more organic polymer or non-polymeric materials capable of supporting the injection of photoexcited holes or transporting electrons from the photoconductive material and allowing the transport of these holes or electrons through the organic layer to selectively dissipate a surface charge. Typical CTMs may also include, for example, a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, hydrazone compounds, and the like. Other typical CTMs may include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene), poly(vinylperylene), and the like. Typical electron transport materials include, for example, electron acceptors such as 2,4,7-trinitro-9-fluorenone; 2,4,5,7-tetranitro-fluorenone; dinitroanthracene; dinitroacridene; tetracyanopyrene, dinitroanthraquinone, and the like. The CTM may also incorporate an antioxidant such as butylated hydroxyl toluene to inhibit oxidation and deterioration of the CTM. The CTM may also incorporate poly (tetrafluoroethylene) (PTFE) in order to reduce wear and enable more efficient toner transfer.

The CTM may also include a resin binder. Any suitable resin binder may be employed in the CTM. Typical inactive resin binders soluble in methylene chloride include polycarbonate resin, polyvinylcarbazole, polyester, polyarylate, polystyrene, polyacrylate, polyether, polysulfone, and the like. Weight average molecular weights can vary, for example, from about 20,000 to about 1,500,000. Preferably, the binder in the CTM includes polycarbonate or copolyester-polycarbonate, optionally including at least a dihedric phenol constituent and an acid dichloride constituent.

Any suitable technique may be utilized to apply the UCM, CGM and/or CTM onto the substrate surface either in a laminate type configuration or in a single layer configuration after altering the texture of the outer surface to the predetermined surface roughness. Typical application techniques include spraying, dip coating, roll coating, wire wound rod coating, and the like, although any technique known to those skilled in the art may be suitable. In one embodiment, dip coating is a preferred coating technique, where the dipping and raising motions of the substrate relative to the coating solution may be accomplished at any suitable speed. Drying of the deposited coating may be effected by any suitable conventional technique such as oven drying, infra-red radiation drying, air drying and the like.

Generally, the thickness of the charge generating layer is preferably substantially uniform, and it may range from about 0.1 micrometer to about 3 micrometers, although other ranges are possible. The thickness of the charge transport layer may range between about 5 micrometers and about 100 micrometers, and optionally between about 20 micrometers and about 30 micrometers, but thicknesses outside these ranges can also be used. In general, the ratio of the thickness of the charge transport layer to the charge generating layer preferably may be maintained from about 2:1 to about 200:1 and in some instances as great as 400:1, although other ratios are possible.

If desired, an optional UCM, or charge blocking layer, may be applied to the substrate surface after alteration of the texture of the outer surface to the predetermined surface roughness and prior to application of the charge generating layer or charge transport layer. Any suitable blocking layer material may be employed. Charge blocking layers are well known in the art. The blocking layer may be organic or inorganic and may be deposited by any suitable technique. Typical blocking layers include polyvinylbutyral, organosilanes, epoxy resins, polyesters, polyamides, polyurethanes, pyroxyline vinylidene chloride resin, silicone resins, fluorocarbon resins and the like. Other blocking layer materials include nitrogen-containing siloxanes or nitrogen-containing titanium compounds such as trimethoxysilyl propylene diamine, hydrolyzed trimethoxysilylpropylethylene diamine, N-beta-(aminoethyl)-gamma-aminopropyltrimethoxy silane, isopropyl-4-aminobenzene sulfonyl, di(dodecylbenzene sulfonyl)titanate, isopropyl-di(4-aminobenzoyl)isostearoyl titanate, isopropyl-tri(N-ethylaminoethylamino)titanate, isopropyl trianthranil titanate, isopropyl-tri-(N,N-dimethylethylamino)titanate, titanium-4-amino benzene sulfonatoxyacetate, titanium 4-aminobenzoate-isostearate-oxyacetate, $[H_2N(CH._2)_4]CH_3Si(OCH_3)_2$, (gamma-aminobutyl)methyl diethoxysilane, and $[H_2N(CH._2)_3]CH_3Si(OCH_3)_2$, (gamma-aminopropyl)methyldiethoxy silane, and the like. The blocking layer should be continuous and may, for example, have an average thickness of up to about 20 microns, although other thicknesses are possible.

A photosensitive imaging member produced according to the processes described above can be tested for print quality assessment in any suitable equipment, such as a Xerox Document Centre 230 (a multifunction laser printing machine) at an initial charging voltage of about 480 volts. In an example, the Document Center 230 may have a 780 nm wavelength laser diode as the exposure source and a single component discharged area development (DAD) system with 7 micrometer toner. Interference fringe effect may be is tested in a gray scale print mode using specified halftone patterns. In am embodiment the interference fringes, or plywood fringes, are not observed in any substantial form, and no degradation of print quality is observed due to black spots. Similar results may be achieved with other laser-based machines, e.g., those with an exposure light source that operates in the range of about 600 to about 800 nm.

Figure 4:
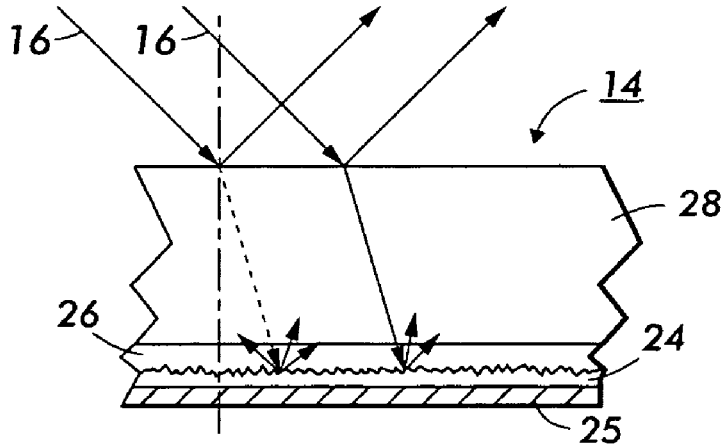
FIG. 4 is a partial cross-sectional view of an exemplary photosensitive imaging member having reduced plywood effect.

An exemplary photosensitive imaging member produced by the methods described above may be understood with reference to FIG. 4. Referring to FIG. 4, a photoreceptor 14 may be layered and include a conductive ground plane 24, formed on a dielectric 25 (such as polyethylene terephthalate (PET)) substrate, a charge generating layer 26, and a semi-transparent charge transport layer 28. An exemplary photoreceptor of this type is described in U.S. Pat. No. 4,588,677, which is incorporated herein by reference in its entirety. The ground plane 24 has a roughened surface (shown greatly exaggerated) causing the light rays 16 penetrating through layers 26 and 28 to be diffusely scattered upon reflection from the surface of ground plane 24. This scattering reduces, and optionally substantially or entirely eliminates, the undesired plywood effect.

The surface and photosensitive imaging member described in the disclosure hereinabove may provide one or more of various advantages. For example, by utilizing the process with the mirror surfaces, the reflective surfaces may be more sensitive, thus allowing for reduced exposure requirements. Additionally, the mirror surface may be easier to inspect from a manufacturing standpoint, and it even may be more aesthetically pleasing to the purchaser of the device. Additionally, the lathing method described herein is cost effective and does not require subsequent processing such as honing for plywood suppression.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of manufacturing a photoreceptor device having a textured surface, comprising:

providing a substrate;

rotating the substrate;

lathing the substrate with a cutting tool and a cutting fluid by at least one pass;

wherein the lathing produces an irregular surface to allow for light scattering;

cleaning the substrate to remove the cutting fluid; and depositing onto the substrate at least one layer.

2. The method of claim 1, wherein the substrate comprises aluminum or an aluminum alloy.

3. The method of claim 1, wherein the cutting fluid comprises:

at least one antioxidant;

one or more surfactants, at least one of which is a polysiloxane surfactant;

at least one lubricant; and water.

4. The method of claim 1, wherein the substrate does not yield substantial coherent reflection.

5. The method of claim 1, wherein a feed rate of the cutting tool is about 0.002 to about 0.010 inches per revolution of the substrate.

6. The method of claim 1, further comprising maintaining the cutting fluid at a substantially neutral pH.

7. The method of claim 1, wherein the at least one layer deposited on the substrate comprises a charge generation layer having a substantially uniform thickness.

8. The method of claim 1, wherein the at least one layer deposited onto the substrate comprises a charge transport material.

9. The method of claim 1, wherein the at least one layer deposited onto the substrate comprises a charge generation layer and a charge transport material.

10. The method of claim 9, wherein at least one of the charge generation layer and the charge transport material includes a binder material.

11. The method of claim 1, wherein the at least one layer deposited onto the substrate comprises a charge blocking layer.

12. The method of claim 1, wherein the lathing and cleaning yield a textured substrate exhibiting a mean surface roughness from about 0.050 microns to about 0.210 microns.

13. The method of claim 1, wherein the lathing and cleaning yield a substrate having a textured surface exhibiting a maximum roughness depth of about 5 microns.

14. The method of claim 1, wherein the method is performed without separately honing the substrate.

15. A method of manufacturing a photoreceptor device having a textured surface, comprising:

lathing a substrate with a cutting fluid by at least one pass;

cleaning the substrate to remove the cutting fluid, wherein the cutting fluid comprises at least one antioxidant, one or more surfactants including a polysiloxane surfactant at least one lubricant, and water;

repeating the lathing and cleaning at least one time each, wherein one or more of a cutting tool, a traverse lathe speed and a feed rate are varied between the repeated lathing steps:

wherein the repeated lathing provides a specular surface while simultaneously providing an irregularly textured surface having a light scattering pattern; and depositing onto the specular surface of the substrate at least one layer.

16. The method of claim 15, further comprising maintaining the cutting fluid at a substantially neutral pH.

17. The method of claim 15, wherein the at least one layer deposited on the substrate comprises at least one of charge generation layer, a charge transport material, and a charge blocking layer.

18. The method of claim 15, wherein the lathing and cleaning yield a textured substrate exhibiting a surface mean surface roughness from about 0.050 microns to about 0.210 microns and a maximum roughness depth of up to about 5 microns.

19. The method of claim 15, wherein the method is performed without separately honing the substrate.

20. The method of claim 15, wherein a first lathing step comprises a rough cut pass, and a second lathing step comprises a finishing pass.

21. The method of claim 20, wherein the finishing pass comprises using a diamond cutting edge.

22. A method of manufacturing a photoreceptor device having a surface that suppresses interference print artifacts, comprising:

rough lathing a substrate with a cutting fluid by at least one rough tool pass;

wherein the cutting fluid comprises at least one antioxidant, one or more surfactants including a polysiloxane surfactant, at least one lubricant, and water; and wherein the rough tool pass comprises a carbide steel tool;

cleaning the substrate to remove the cutting fluid;

finish lathing and cleaning the substrate at least one time each, wherein one or more of a traverse lathe speed and a feed rate are varied between the rough lathing and the finish lathing steps;

wherein the finish lathing comprises a diamond cut; and wherein the finish lathing provides a specular surface while simultaneously providing an irregularly textured surface having a light scattering pattern; and depositing onto the substrate at least one layer.

* * * * *